US005490545A

United States Patent [19]

Sokoloff et al.

[11] Patent Number: 5,490,545

[45] Date of Patent: Feb. 13, 1996

[54] VORTEX CONNECTOR

[75] Inventors: Michael D. Sokoloff, 2616 Madison Rd., Cincinnati, Ohio 45208; Randy A. Johnson, Cincinnati, Ohio

[73] Assignee: Michael D. Sokoloff, Cincinnati, Ohio

[21] Appl. No.: 298,293

[22] Filed: Aug. 31, 1994

[51] Int. Cl.[6] ..... B65B 3/04

[52] U.S. Cl. ..... 141/319; 141/286; 141/364; 141/375; 138/40

[58] Field of Search ..... 141/286/319, 363, 141/364, 375; 248/311.3; 211/74; 138/40, 44

[56] References Cited

U.S. PATENT DOCUMENTS

| | | | |
|---|---|---|---|
| 1,744,842 | 1/1930 | Suverkrop et al. | 138/44 |
| 2,773,521 | 12/1956 | Persson | 141/319 X |
| 3,146,798 | 9/1964 | Chenault | 138/44 |
| 3,444,897 | 5/1969 | Erickson | 138/145 |
| 3,572,391 | 3/1971 | Hirsch | 138/40 |
| 4,105,142 | 8/1978 | Morris, Jr. | 141/319 X |
| 4,125,226 | 11/1978 | Nieuwkamp | 239/468 |
| 4,331,294 | 5/1982 | Gilad | 239/222.17 |
| 4,336,891 | 6/1982 | Smith | 215/276 |
| 4,427,030 | 1/1984 | Jouwsma | 138/40 X |
| 4,625,780 | 12/1986 | Burnham | 141/319 |
| 4,936,335 | 6/1990 | Macon | 137/268 |

*Primary Examiner*—J. Casimer Jacyna
*Attorney, Agent, or Firm*—Kerkam, Stowell, Kondracki & Clarke; William L. Feeney

[57] ABSTRACT

A vortex connector system has a connector body with a projection therein to selectively abut one of a plurality of removable inserts. The removable inserts have holes with different sizes, shapes, patterns, depths, and numbers in order to allow observation of how such variations affect the vortex effect and/or flow rate of fluid between plastic bottles connected by the connector body.

23 Claims, 1 Drawing Sheet

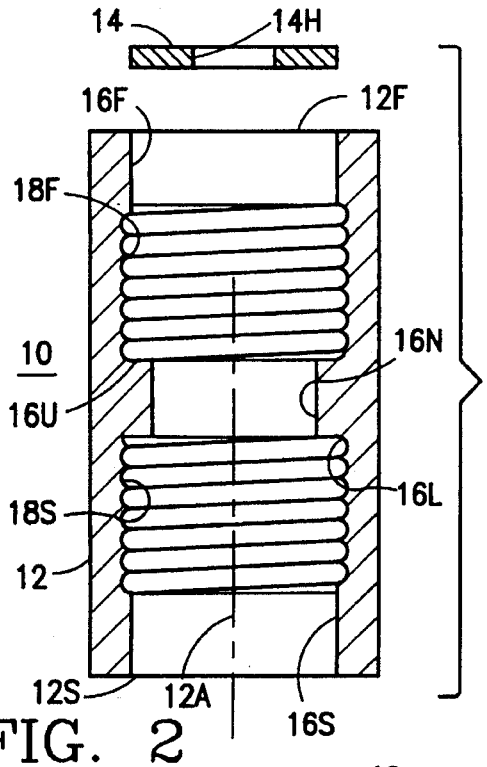
FIG. 1
FIG. 2
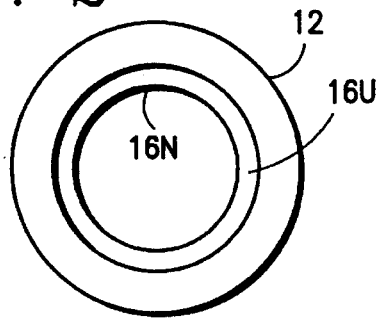
FIG. 3
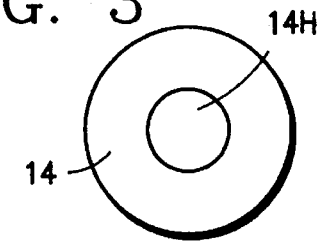
FIG. 4
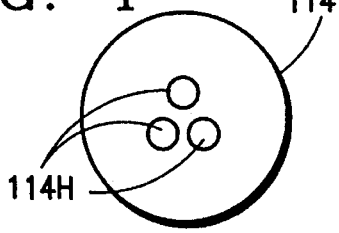
FIG. 5
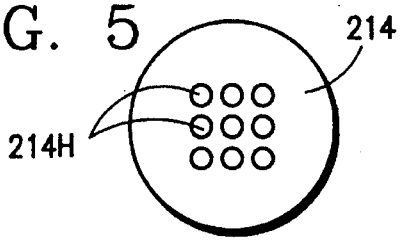
FIG. 6
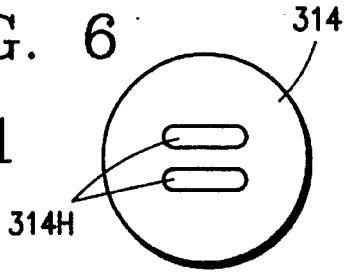
FIG. 7
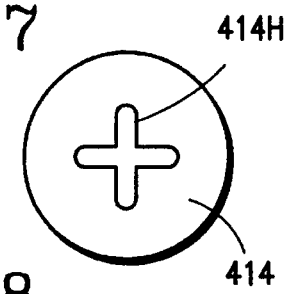
FIG. 8
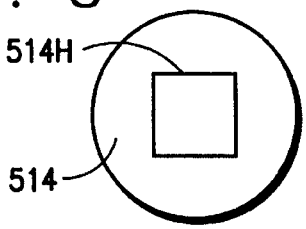
FIG. 9
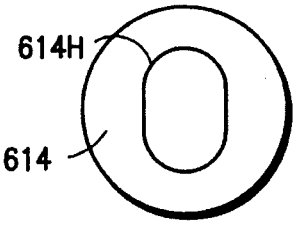
FIG. 10
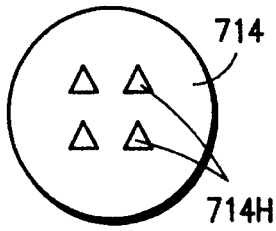
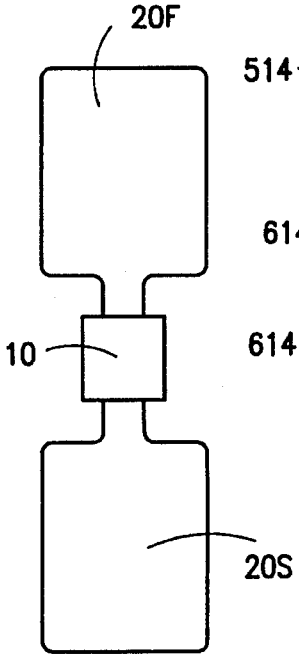
FIG. 11

VORTEX CONNECTOR

BACKGROUND OF THE INVENTION

This invention relates to an improved vortex connector which allows fluid flow between two bottles. More specifically, the connector provides for different experimental effects simulating a tornado.

U.S. Pat. No. 4,625,780, issued Dec. 2, 1986 to Burnham, entitled VORTEX CONNECTOR, and hereby incorporated by reference, discloses a connector for connecting two plastic bottles in order to produce a vortex. Liquid flowing between the bottles will simulate a tornado. This is a scientific amusement and can be used to demonstrate scientific principles for stimulating the imagination of children and adults.

That invention has been very useful for both amusement and educational purposes. However, that invention has limited flexibility in the sense that it is a single connector with fixed characteristics. Therefore, it does not readily lend itself to making variations in the connector to determine how the vortex effect will be changed.

OBJECTS AND SUMMARY OF THE INVENTION

Accordingly, it is a primary object of the present invention to provide a new and improved vortex connector and vortex connector system.

A more specific object of the present invention is to provide a vortex connector system allowing one to vary the characteristics of the connector to determine what effect, if any, such variations will have on the vortex generated by use of the connector.

A further object of the present invention is to provide a vortex connector which may selectively generate different patterns of vortices.

Yet another object of the present invention is to provide a great deal of flexibility in conducting experiments and demonstrations using vortex connectors.

The above and other features of the present invention, which will be more readily understood when the following detailed description is considered in conjunction with the accompanying drawings, are realized by a vortex connector for at least one bottle having a male helically-threaded neck including a hollow tubular-threaded connector body. The connector body has female helical threads disposed internally within at least a first open end thereof, a second open end opposite the first open end, a wide opening passage between the first and second open ends, and an insert-abutting projection adjacent the wide opening passage. A removable first insert abuts the insert-abutting projection. The first insert has at least a first insert opening therethrough. The first insert opening has a smaller cross-sectional area than a cross-sectional area of the wide opening passage such that any vortex effects on usage of the vortex connector with the first insert is dependent on the first insert.

Preferably, the first insert is a flat member with opposite flat sides. More specifically, the first insert is a disc with a circular outer diameter.

The first insert further may have a second insert opening therethrough, the second insert opening having a smaller cross-sectional area than the cross-sectional area of the wide opening passage. The first insert may further have a third insert opening therethrough, the third insert opening having a smaller cross-sectional area than the cross-sectional area of the wide opening passage.

In some embodiments, the first insert opening is non-circular.

In some embodiments, the first insert further has a second insert opening therethrough, the second insert opening having a smaller cross-sectional area than the cross-sectional area of the wide opening passage.

The vortex connector may further include a second insert for removable placement against the insert-abutting projection, the second insert having its own insert opening with different characteristics (meaning shape, length, size, depth, and/or cross sectional area) than the first insert opening.

The vortex connector may further include a third insert for removable placement against the insert-abutting projection, the third insert having its own insert opening with different characteristics than the insert openings of the first and second inserts. The connector body, first, second, and third inserts collectively constitute a vortex connector system.

The connector further includes female helical threads disposed internally within the second open end thereof. The wide opening passage is between the female helical threads within the first open end and the female helical threads within the second open end. The connector body is cylindrical with a body diameter and the female helical threads have a groove thread diameter (i.e., diameter in the grooves or recesses of the threads).

The wide opening passage is constructed such that, at sea level, the weight of water in a bottle connected to the connector will overcome surface tension and flow from a bottle without rotational movement being required. More specifically, the wide opening passage is circular and at least ½ inch in diameter. Further, the wide opening passage diameter is greater than 50% of the groove thread diameter. More specifically, the wide opening passage diameter is greater than 55% of the groove thread diameter.

The present invention may alternately be described as a vortex connector system for at least one bottle (having a male helically-threaded neck) including: a hollow tubular-threaded connector body having female helical threads disposed internally within at least a first open end thereof, a second open end opposite the first open end, a wide opening passage between the first and second open ends, and an insert-abutting projection adjacent the wide opening passage. The system has removable first and second inserts sized and shaped for abutting the insert-abutting projection, the first and second inserts each having at least one opening therethrough. The openings in the first and second inserts each having different characteristics and each having a smaller cross-sectional area than a cross-sectional area of the wide opening passage such that any vortex effects on usage of the vortex connector system is dependent on which of the first and second inserts is abutting the insert-abutting projection. Each of the first and second inserts is a disc with opposite flat sides. The insert-abutting projection is an annular ledge.

The vortex connector system may further include a third insert having at least one opening therethrough, the opening in the third insert having different characteristics from the openings in the first and second inserts and having a smaller cross-sectional area than a cross-sectional area of the wide opening passage such that any vortex effects on usage of the vortex connector system is dependent on which of the first, second, and third inserts is abutting the insert-abutting projection.

In some embodiments, the openings in the first and second inserts are of different sizes. In some embodiments, the openings in the first and second inserts are of different shapes. In some embodiments, at least one of the first and second inserts has a plurality of openings therethrough.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 1 shows a side cross sectional view with parts exploded of a vortex connector according to the present invention;

FIG. 2 shows a top view of a connector body of the present invention;

FIG. 3 shows a top view of an insert from FIG. 1;

FIG. 4 shows a top view of another insert;

FIG. 5 shows a top view of another insert;

FIG. 6 shows a top view of another insert;

FIG. 7 shows a top view of another insert;

FIG. 8 shows a top view of another insert;

FIG. 9 shows a top view of another insert;

FIG. 10 shows a top view of another insert; and

FIG. 11 shows a side view of the connector body of the present invention disposed between two bottles.

DETAILED DESCRIPTION

As shown in FIGS. 1, 2, and 3, the vortex connector of the present invention includes a connector body 12 (FIGS. 1 and 2 only) and an insert 14 (FIGS. 1 and 3 only) which is shaped and sized to be removably placed against an insert-abutting projection portion 16U. As clearly illustrated in FIG. 1, the insert 14 is freely movable, meaning that it may be moved, even after its use between two bottles, without breaking a connection between it and any other object and without moving any other object (i.e., such as the connector body 12 or any bottles used therewith). As also clearly illustrated in FIG. 1, the connector body is a fixed length (i.e., distance along axis 12A). In the embodiment shown, the connector body is cylindrical and centered about axis 12A and projection portion 16U is an annular ledge also centered about axis 12A. Portion 16U is the upper edge of a reduced inner diameter section 16N having an annular lower edge projection portion 16L. The section 16N defines a wide opening passage therein and in between first and second ends 16F and 16S.

The hollow connector body 12 has first and second open ends 12F and 12S with corresponding first and second female helical rope threads 18F and 18S shaped and sized to thread to male threads of one or two bottles as discussed in detail below.

The insert 14 is preferably a ring disc with a circular hole 14H disposed therein. Since the hole 14H is smaller in cross sectional area than the cross sectional area of the (relatively) wide passage within 16N, placement of the insert 14 against either of portions 16U or 16L will restrict flow of fluid such that any vortex effects of liquid flowing between 16F and 16S will depend on the characteristics of the insert 14. The characteristics possibly affecting the vortex effects include size (i.e., cross sectional area), shape, number, pattern, and depth (i.e., thickness of insert) of the hole or holes in the insert.

Further the use of different inserts within connector body 12 may allow one to study how size relates to fluid flow, whether through vortex motion or not. Additionally, larger orifices or holes on some inserts allow them to produce vortices with liquids having greater viscosity than water. For example, a mixture of water with vegetable oil will not form a vortex using a given standard size hole, but use of a larger hole will allow a vortex to form with such a mixture.

By use of different inserts as described below, one may hold the total cross sectional area (i.e., surface area of surface perpendicular to a line normal to the opposite flat surfaces of the disc insert 14) constant and vary the shape of a single hole. A square hole could be compared with a round hole or orifice of the same area. A single circular hole could be compared with 9 smaller circular holes with collectively the same cross sectional area as the single circular hole. One could hold the number and sizes of holes constant, but increase the space between holes. One may use inserts with round holes, rectangular holes, oval holes, irregularly shaped holes, etc.

As used herein, a vortex connector system includes a connector body such as 12 together with at least two different inserts.

FIG. 4 shows an insert with three circular holes 114H, whereas FIG. 5 shows an insert 214 with 9 circular holes 214H (only some labeled). FIG. 6 show insert 314 with two parallel slot holes 314H. FIG. 7 is an insert 414 with a cross or plus sign shaped hole 414H. The insert 514 of FIG. 8 has square hole 514H. FIG. 9 insert 614 has oval hole 614H. FIG. 10 is an insert 714 having four triangular holes 714H (only some labeled).

The manner of use of the present invention is essentially the same as in the incorporated by reference Burnham patent and is shown in FIG. 11 illustrating connector 10 in between first and second plastic soda bottles 20F and 20S. Initially, one would put one or more of the inserts into one or more ends of the body 12 of FIG. 1 such that the inserts abut projection portion 16U and/or 16L. The threads 18F would be threaded into an empty bottle 20S and the threads 18S are threaded to a partially full bottle 20F. Initially, the full bottle would be lower with the empty bottle vertically above it. The assembly of the two bottles and connector 10 are inverted 180 degrees such that the full bottle 20F is on top as shown in FIG. 11. The full bottle is than given an axial twist to start liquid in the upper bottle flowing into the lower bottle by vortex or otherwise. Without the insert, the preferred design will not sustain vortex effects. As explained in the incorporated by reference Burnham patent, a vortex permits the air in a lower bottle to flow upwardly through the vortex, while liquid descends around the air.

Although specific constructions and examples have been presented herein, it is to be understood that these are for illustrative purposes only. Various modifications and adaptations will be apparent to those of skill in the art. In view of possible modifications, it will be appreciated that the scope of the present invention should be determined by reference to the claims appended hereto.

What is claimed is:

1. A vortex connector for at least one bottle having a male helically-threaded neck comprising a hollow tubular-threaded connector body having female helical threads disposed internally within at least a first open end thereof, a second open end opposite said first open end, a wide opening passage between said first and second open ends, an insert-abutting projection adjacent said wide opening passage, and a removable first insert abutting said insert-abutting projection, said first insert being freely movable and having at least a first insert opening therethrough, said first insert opening having a smaller cross-sectional area than a cross-sectional area of said wide opening passage such that any vortex effects on usage of said vortex connector with said first insert is dependent on said first insert, and wherein said connector body has a fixed length and said first insert creates vortex effects on usage of said vortex connector.

2. The vortex connector of claim 1 wherein said first insert is a flat member with opposite flat sides.

3. The vortex connector of claim 2 wherein said first insert is a disc with a circular outer diameter.

4. The vortex connector of claim 3 wherein said first insert further has a second insert opening therethrough, said second insert opening having a smaller cross-sectional area than the cross-sectional area of said wide opening passage.

5. The vortex connector of claim 4 wherein said first insert further has a third insert opening therethrough, said third insert opening having a smaller cross-sectional area than the cross-sectional area of said wide opening passage.

6. The vortex connector of claim 3 wherein said first insert opening is non-circular.

7. The vortex connector of claim 1 wherein said first insert further has a second insert opening therethrough, said second insert opening having a smaller cross-sectional area than the cross-sectional area of said wide opening passage.

8. The vortex connector of claim 1 wherein said first insert opening is non-circular.

9. The vortex connector of claim 1 further comprising a second insert for removable placement against said insert-abutting projection, said second insert having its own insert opening with different characteristics than said first insert opening.

10. The vortex connector of claim 9 further comprising a third insert for removable placement against said insert-abutting projection, said third insert having its own insert opening with different characteristics than the insert openings of said first and second inserts; said connector body, first, second, and third inserts collectively constituting a vortex connector system.

11. The vortex connector of claim 1 further comprising female helical threads disposed internally within said second open end thereof, and wherein said wide opening passage is between said female helical threads within said first open end and said female helical threads within said second open end.

12. The vortex connector of claim 1 wherein said connector body is cylindrical and said wide opening passage is constructed such that, at sea level, the weight of water in a bottle connected to the connector will overcome surface tension and flow from a bottle without rotational movement being required.

13. A vortex connector system for at least one bottle having a male helically-threaded neck comprising: a hollow tubular-threaded connector body having female helical threads disposed internally within at least a first open end thereof, a second open end opposite said first open end, a wide opening passage between said first and second open ends, an insert-abutting projection adjacent said wide opening passage, and removable first and second inserts sized and shaped for abutting said insert-abutting projection, said first and second inserts each having at least one opening therethrough, the openings in said first and second inserts each having different characteristics and each having a smaller cross-sectional area than a cross-sectional area of said wide opening passage such that any vortex effects on usage of said vortex connector system is dependent on which of said first and second inserts is abutting said insert-abutting projection, and wherein at least one of the first and second inserts creates vortex effects on usage of said vortex connector system.

14. The vortex connector system of claim 13 wherein said connector body is cylindrical.

15. The vortex connector system of claim 13 wherein each of said first and second inserts is a disc with opposite flat sides.

16. The vortex connector system of claim 13 wherein said insert-abutting projection is an annular ledge.

17. The vortex connector system of claim 13 further comprising a third insert having at least one opening therethrough, the opening in said third insert having different characteristics from the openings in said first and second inserts and having a smaller cross-sectional area than a cross-sectional area of said wide opening passage such that any vortex effects on usage of said vortex connector system is dependent on which of said first, second, and third inserts is abutting said insert-abutting projection.

18. The vortex connector system of claim 13 wherein said openings in said first and second inserts are of different sizes.

19. The vortex connector system of claim 13 wherein said openings in said first and second inserts are of different shapes.

20. The vortex connector system of claim 13 wherein at least one of the first and second inserts has a plurality of openings therethrough.

21. The vortex connector system of claim 13 wherein each of said first and second inserts is freely movable.

22. The vortex connector system of claim 13 wherein at least one of the first and second inserts has a plurality of openings therethrough.

23. The vortex connector system of claim 13 wherein both of the first and second inserts creates vortex effects on usage of said vortex connector system.

* * * * *